US007941082B2

(12) United States Patent
Kosako et al.

(10) Patent No.: US 7,941,082 B2
(45) Date of Patent: May 10, 2011

(54) COLOR-IMAGE FORMING APPARATUS, IMAGE FORMING METHOD, AND COMPUTER PROGRAM PRODUCT

(75) Inventors: Jun Kosako, Kanagawa (JP); Shigeyuki Ishii, Kanagawa (JP); Takashi Enami, Kanagawa (JP); Nobuyuki Kobayashi, Kanagawa (JP); Natsuko Kawase, Kanagawa (JP); Takahiro Kamekura, Kanagawa (JP); Takahiro Miyakawa, Kanagawa (JP); Miyo Taniguchi, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 12/708,901

(22) Filed: Feb. 19, 2010

(65) Prior Publication Data

US 2010/0239294 A1 Sep. 23, 2010

(30) Foreign Application Priority Data

Mar. 18, 2009 (JP) ..... 2009-067073

(51) Int. Cl.
*G03G 15/01* (2006.01)

(52) U.S. Cl. ..... 399/301; 399/66; 399/72; 399/302

(58) Field of Classification Search ..... 399/9, 38, 399/66, 72, 75, 121, 297, 299–302, 308, 399/394

See application file for complete search history.

(56) References Cited

U.S. PATENT DOCUMENTS

| | | | | |
|---|---|---|---|---|
| 7,260,335 | B2 | 8/2007 | Kato et al. | |
| 7,548,704 | B2 | 6/2009 | Hasegawa et al. | |
| 2007/0230979 | A1 * | 10/2007 | Hasegawa et al. | 399/49 |
| 2009/0022525 | A1 * | 1/2009 | Martin et al. | 399/298 |

FOREIGN PATENT DOCUMENTS

| | | |
|---|---|---|
| JP | 2006-126643 | 5/2006 |
| JP | 4042127 | 11/2007 |

* cited by examiner

*Primary Examiner* — David P Porta
*Assistant Examiner* — Benjamin Schmitt
(74) *Attorney, Agent, or Firm* — Oblon, Spivak, McClelland, Maier & Neustadt, L.L.P.

(57) ABSTRACT

A print control unit causes a secondary-transfer control unit to move a secondary transfer unit apart from an intermediate transfer member, causes a direct-transfer control unit to cause a black image forming unit to form a black image and transfer the black image onto a transfer sheet being conveyed along a conveying path, and causes a positional-alignment control unit to perform positional alignment.

9 Claims, 10 Drawing Sheets

FIG. 8

| | |
|---|---|
| PRINTING MODE | FULL-COLOR |
| K PHOTOSENSITIVE ELEMENT | PRINTING |
| M PHOTOSENSITIVE ELEMENT | PRINTING |
| C PHOTOSENSITIVE ELEMENT | PRINTING |
| Y PHOTOSENSITIVE ELEMENT | PRINTING |
| SECONDARY TRANSFER ROLLER | IN CONTACT |

FIG. 9

| | |
|---|---|
| PRINTING MODE | MONO-CHROME |
| K PHOTOSENSITIVE ELEMENT | PRINTING |
| M PHOTOSENSITIVE ELEMENT | STOP |
| C PHOTOSENSITIVE ELEMENT | STOP |
| Y PHOTOSENSITIVE ELEMENT | STOP |
| SECONDARY TRANSFER ROLLER | NOT IN CONTACT |

FIG. 10

| | |
|---|---|
| PRINTING MODE | MONO-CHROME |
| K PHOTOSENSITIVE ELEMENT | PRINTING |
| M PHOTOSENSITIVE ELEMENT | COLOR ALIGNMENT |
| C PHOTOSENSITIVE ELEMENT | COLOR ALIGNMENT |
| Y PHOTOSENSITIVE ELEMENT | COLOR ALIGNMENT |
| SECONDARY TRANSFER ROLLER | NOT IN CONTACT |

FIG. 11

| | | | |
|---|---|---|---|
| PRINTING MODE | FULL-COLOR | MONO-CHROME | STOP |
| K PHOTOSENSITIVE ELEMENT | PRINTING | PRINTING | STOP |
| M PHOTOSENSITIVE ELEMENT | PRINTING | COLOR ALIGNMENT | |
| C PHOTOSENSITIVE ELEMENT | PRINTING | COLOR ALIGNMENT | |
| Y PHOTOSENSITIVE ELEMENT | PRINTING | COLOR ALIGNMENT | |
| SECONDARY TRANSFER ROLLER | IN CONTACT | NOT IN CONTACT | |

TIME →

FIG. 12

| | | | | |
|---|---|---|---|---|
| PRINTING MODE | FULL-COLOR | MONO-CHROME | STOP | MONO-CHROME |
| K PHOTOSENSITIVE ELEMENT | PRINTING | PRINTING | STOP | PRINTING |
| M PHOTOSENSITIVE ELEMENT | PRINTING | COLOR ALIGNMENT | | |
| C PHOTOSENSITIVE ELEMENT | PRINTING | COLOR ALIGNMENT | | |
| Y PHOTOSENSITIVE ELEMENT | PRINTING | COLOR ALIGNMENT | | |
| SECONDARY TRANSFER ROLLER | IN CONTACT | NOT IN CONTACT | | |

TIME →

FIG. 13

| | | | | | |
|---|---|---|---|---|---|
| PRINTING MODE | FULL-COLOR | MONO-CHROME | STOP | FULL-COLOR | |
| K PHOTOSENSITIVE ELEMENT | PRINTING | PRINTING | STOP | STANDBY | PRINTING |
| M PHOTOSENSITIVE ELEMENT | PRINTING | COLOR ALIGNMENT | | | PRINTING |
| C PHOTOSENSITIVE ELEMENT | PRINTING | COLOR ALIGNMENT | | | PRINTING |
| Y PHOTOSENSITIVE ELEMENT | PRINTING | COLOR ALIGNMENT | | | PRINTING |
| SECONDARY TRANSFER ROLLER | IN CONTACT | NOT IN CONTACT | | | IN CONTACT |

TIME →

FIG. 14

| | | | |
|---|---|---|---|
| PRINTING MODE | FULL-COLOR | UN-PRINTABLE | FULL-COLOR |
| K PHOTOSENSITIVE ELEMENT | PRINTING | STOP | PRINTING |
| M PHOTOSENSITIVE ELEMENT | PRINTING | COLOR ALIGNMENT | PRINTING |
| C PHOTOSENSITIVE ELEMENT | PRINTING | COLOR ALIGNMENT | PRINTING |
| Y PHOTOSENSITIVE ELEMENT | PRINTING | COLOR ALIGNMENT | PRINTING |
| SECONDARY TRANSFER ROLLER | IN CONTACT | NOT IN CONTACT | CONTACT |

TIME →

COLOR-IMAGE FORMING APPARATUS, IMAGE FORMING METHOD, AND COMPUTER PROGRAM PRODUCT

CROSS-REFERENCE TO RELATED APPLICATIONS

The present application claims priority to and incorporates by reference the entire contents of Japanese Patent Application No. 2009-067073 filed in Japan on Mar. 18, 2009.

BACKGROUND OF THE INVENTION

1. Field of the Invention

The present invention relates to a color-image forming apparatus, an image forming method, and a computer program product.

2. Description of the Related Art

In accordance with market demand, electrophotographic devices that can output color images, such as color copiers and color printers, are used more and more. Especially, with the demand for color-image outputting speeds as high as monochrome-image outputting speeds, tandem-type color-image forming apparatuses that include color-based photosensitive elements and color-based developing devices have recently become mainstream. The tandem-type color-image forming apparatuses form toner images with different single colors on individual photosensitive elements and then sequentially transfer the single-color toner images onto a transfer sheet, thereby recording a color image (see, for example, Japanese Patent Application Laid-open No. 2006-126643).

In a typical tandem-type color-image forming apparatus, regardless of whether it is a direct-transfer type or an intermediate-transfer type, the single-color images are transferred from the individual photosensitive elements, at different positions on an intermediate transfer belt, to the intermediate transfer belt or the transfer sheet; therefore, even a fine change in the moving speed of the intermediate transfer belt alters the timing at which the intermediate transfer belt reaches the transfer position of the next single-color image, which in turn causes the transfer positions of the single-color images to shift from the correct positions, which results in an output image with misalignment (color shift) in the sub-scanning direction.

A typical tandem-type color-image forming apparatus includes writing units separated from each other on the basis of color. If the constituents are displaced from the correct positions due to an environmental change, such as a temperature change, which in turn changes the magnifying power and the writing position, an output image with misalignment (color shift) in the main-scanning direction is formed.

To prevent misalignment, a typical tandem-type color-image forming apparatus forms a specific pattern image for positional alignment on the intermediate transfer belt between the image processing area for a first page and the image processing area for a second page. A typical tandem-type color-image forming apparatus detects misalignment (color shift) in both the main-scanning direction and the sub-scanning direction using the pattern image and performs positional alignment to correct the detected misalignment (color shift).

However, because the above-described positional alignment needs a given processing time, a period of downtime during which the printing process cannot be performed occurs, which decreases the printing performance. Moreover, if, because of the timer setting or the like, the positional alignment interrupts the monochrome printing that does not require a positional alignment, although the positional alignment is not needed, the monochrome printing is interrupted and thus the printing performance decreases.

Japanese Patent Application Laid-open No. 2006-126643 discloses a technology that prevents the decrease in the printing performance caused by the positional alignment. If an engine control unit receives a print job from a controller unit before the start of the positional alignment, the engine control unit delays the positional alignment. If the engine control unit receives a print job during the positional alignment, the engine control unit suspends the positional alignment and starts the print job.

However, according to the technology disclosed in Japanese Patent Application Laid-open No. 2006-126643, because the intermediate transfer member is not able to perform printing during the positional alignment, the problem of the decrease in the printing performance cannot be solved.

SUMMARY OF THE INVENTION

It is an object of the present invention to at least partially solve the problems in the conventional technology.

According to an aspect of the present invention, there is provided a color-image forming apparatus that includes a direct-transfer control unit that causes a black image forming unit to form a black image to be transferred onto a transfer sheet being conveyed along a conveying path; an indirect-transfer control unit that causes a plurality of color image forming units other than the black image forming unit and an intermediate transfer member to form, on the intermediate transfer member, a multi-color image in a superimposed manner to be transferred onto the transfer sheet being conveyed along the conveying path; a positional-alignment control unit that performs positional alignment by detecting amounts of main-scanning and sub-scanning directional misalignment of color images that are formed by the color image forming units other than the black image forming unit and then transferred onto the intermediate transfer member in the superimposed manner and correcting the misalignment; a secondary transfer unit that is located at a position on the conveying path of the transfer sheet at which both the multi-color image, which is formed on the intermediate transfer member in the superimposed manner under control of the indirect-transfer control unit, and the black image, which is formed and transferred onto the transfer sheet under control of the direct-transfer control unit, join together in a superimposed manner, and that is provided movable close to and apart from the intermediate transfer member; a secondary-transfer control unit that moves the secondary transfer unit close to and apart from the intermediate transfer member; and a print control unit that causes the secondary-transfer control unit to move the secondary transfer unit apart from the intermediate transfer member, causes the direct-transfer control unit to cause the black image forming unit to form the black image and transfer the black image onto the transfer sheet being conveyed along the conveying path, and causes the positional-alignment control unit to perform the positional alignment.

According to another aspect of the present invention, there is provided a color-image forming method that is performed by a color-image forming apparatus. The apparatus includes a direct-transfer control unit that causes a black image forming unit to form a black image to be transferred onto a transfer sheet being conveyed along a conveying path; an indirect-transfer control unit that causes a plurality of color image forming units other than the black image forming unit and an intermediate transfer member to form, on the intermediate transfer member, a multi-color image in a superimposed manner to be transferred onto the transfer sheet being conveyed along the conveying path; a positional-alignment control unit that performs positional alignment by detecting amounts of main-scanning and sub-scanning directional misalignment of color images that are formed by the color image forming units other than the black image forming unit and then transferred onto the intermediate transfer member in the superimposed manner and correcting the misalignment; a secondary-transfer control unit that moves a secondary transfer unit close to and apart from the intermediate transfer member, wherein the secondary transfer unit is located at a position along the conveying path of the transfer sheet at which both the multi-color image, which is formed on the intermediate transfer member in the superimposed manner under control of the indirect-transfer control unit, and the black image, which is formed and transferred onto the transfer sheet under control of the direct-transfer control unit, join together in a superimposed manner, and the secondary transfer unit is provided movable close to and apart from the intermediate transfer member; a controller that includes a print control unit; and a storage unit. The color-image forming method includes, under control of the print control in the controller, causing the secondary-transfer control unit to move the secondary transfer unit apart from the intermediate transfer member; causing the direct-transfer control unit to cause the black image forming unit to form the black image and transfer the black image onto the transfer sheet being conveyed along the conveying path; and causing the positional-alignment control unit to perform the positional alignment.

According to still another aspect of the present invention, there is provided a computer program product including a computer-usable medium having computer-readable program codes embodied in the medium for forming a color image in a color-image forming apparatus. The apparatus includes a direct-transfer control unit that causes a black image forming unit to form a black image to be transferred onto a transfer sheet being conveyed along a conveying path; an indirect-transfer control unit that causes a plurality of color image forming units other than the black image forming unit and an intermediate transfer member to form, on the intermediate transfer member, a multi-color image in a superimposed manner to be transferred onto the transfer sheet being conveyed along the conveying path; a positional-alignment control unit that performs positional alignment by detecting amounts of main-scanning and sub-scanning directional misalignment of color images that are formed by the color image forming units other than the black image forming unit and then transferred onto the intermediate transfer member in the superimposed manner and correcting the misalignment; and a secondary-transfer control unit that moves a secondary transfer unit close to and apart from the intermediate transfer member. The secondary transfer unit is located at a position along the conveying path of the transfer sheet at which both the multi-color image, which is formed on the intermediate transfer member in the superimposed manner under control of the indirect-transfer control unit, and the black image, which is formed and transferred onto the transfer sheet under control of the direct-transfer control unit, join together in a superimposed manner, and the secondary transfer unit is provided movable close to and apart from the intermediate transfer member. The program codes when executed causing a computer to execute causing the secondary-transfer control unit to move the secondary transfer unit apart from the intermediate transfer member; causing the direct-transfer control unit to cause the black image forming unit to form the black image and transfer the black image onto the transfer sheet being conveyed along the conveying path; and causing the positional-alignment control unit to perform the positional alignment.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 8 is a schematic diagram that explains operations of photosensitive elements and the secondary transfer roller during full-color printing;

FIG. 9 is a schematic diagram that explains operations of the photosensitive elements and the secondary transfer roller during monochrome printing;

FIG. 10 is a schematic diagram that explains operations of the photosensitive elements and the secondary transfer roller during positional alignment;

FIG. 11 is a schematic diagram that explains a first example of the system control;

FIG. 12 is a schematic diagram that explains that explains a second example of the system control;

FIG. 13 is a schematic diagram that explains that explains a third example of the system control; and FIG. 14 is a schematic diagram that explains a fourth example of the system control.

DETAILED DESCRIPTION OF THE PREFERRED EMBODIMENTS

Exemplary embodiments of color-image forming apparatuses, image forming methods, and computer programs according to the present invention are described in detail below with reference to the accompanying drawings.

An embodiment of the present invention is described below with reference to FIGS. 1 to 14. A color-image forming apparatus used in the present embodiment is a color and digital multi function peripheral (MFP) that has various functions, such as a copy function, a facsimile (FAX) function, a printer function, a scanner function, and a received-image distributing function (i.e., function to distribute an image of an original scanned by the scanner function or an image received by the printer function or the FAX function).

Figure 1:
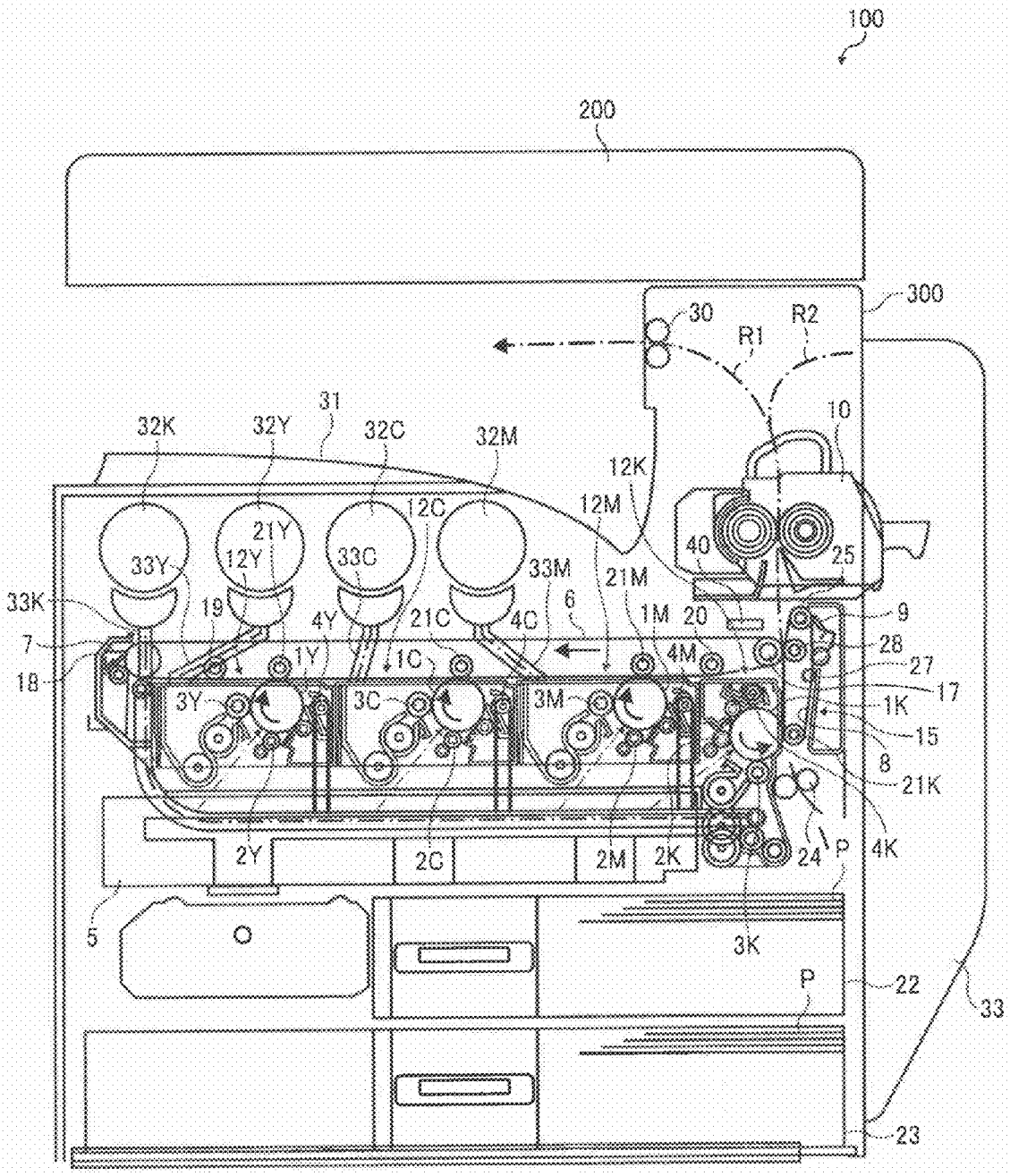
FIG. 1 is a schematic diagram of an inner configuration of a color digital MFP according to an embodiment of the present invention.

FIG. 1 is a schematic diagram of an inner configuration of a color digital MFP 100 according to the embodiment of the present invention. As shown in FIG. 1, the color digital MFP 100 includes a scanner unit 200 that is an image scanning device and a printer unit 300 that is an image printing device. The scanner unit 200 and the printer unit 300 constitute an engine control unit 500 (see FIG. 3). In the color digital MFP 100 according to the present embodiment, various functions, such as the document-box function, the copy function, the printer function, and the FAX function, are selectable by sequentially switching among these functions using an application switching key on an operation unit 400 (see FIG. 3). When the document-box function is selected, the document-box mode is on; when the copy function is selected, the copy mode is on; when the printer function is selected, the printer mode is on; and the FAX function is selected, the FAX mode is on.

The printer unit 300, which has a peculiar function of the color digital MFP 100 according to the present embodiment, is described in detail below. As shown in FIG. 1, the printer unit 300 of the color digital MFP 100 is a tandem-type device that includes three or yellow, cyan, and magenta (hereinafter, "Y", "C", and "M") image forming units 12Y, 12C, and 12M arranged in a row along an intermediate transfer belt 6 in the belt moving direction. The intermediate transfer belt 6 is a looped intermediate transfer member extending in the substantially horizontal direction. The intermediate transfer belt 6 is supported by a driving roller 17, a driven roller 18, and supporting rollers 19 and 20. A cleaning unit 7 that removes residual toners from the intermediate transfer belt 6 is arranged at the position opposite to the driven roller 18 outside of the intermediate transfer belt 6.

The printer unit 300 of the color digital MFP 100 further includes a black (K) image forming unit 12K upstream of the tandem arrangement in the transfer-paper (recording-sheet) moving direction in a separate manner. The black (K) image forming unit 12K is arranged so that a toner image is directly transferred from the black image forming unit 12K onto a transfer sheet. More particularly, the black image forming unit 12K is separated from the other image forming units 12Y, 12C, and 12M. The black toner image that is formed on the black image forming unit 12K is directly transferred onto the transfer sheet using a secondary transfer unit 15, not onto the intermediate transfer belt 6. The secondary transfer unit 15 is substantially perpendicular to the intermediate transfer belt 6 extending in the substantially horizontal direction and is located at a position along a conveying path of a transfer sheet P at which both the multi-color image, which is formed on the intermediate transfer belt 6 in the superimposed manner, and the black image, which is transferred onto the transfer sheet P, join together in a superimposed manner. More particularly, the black image forming unit 12K is arranged near and along the substantially vertical conveying path of the transfer sheet. The secondary transfer unit 15 is arranged in a space near the substantially vertical conveying path upstream of a fixing device 10.

Figure 2:
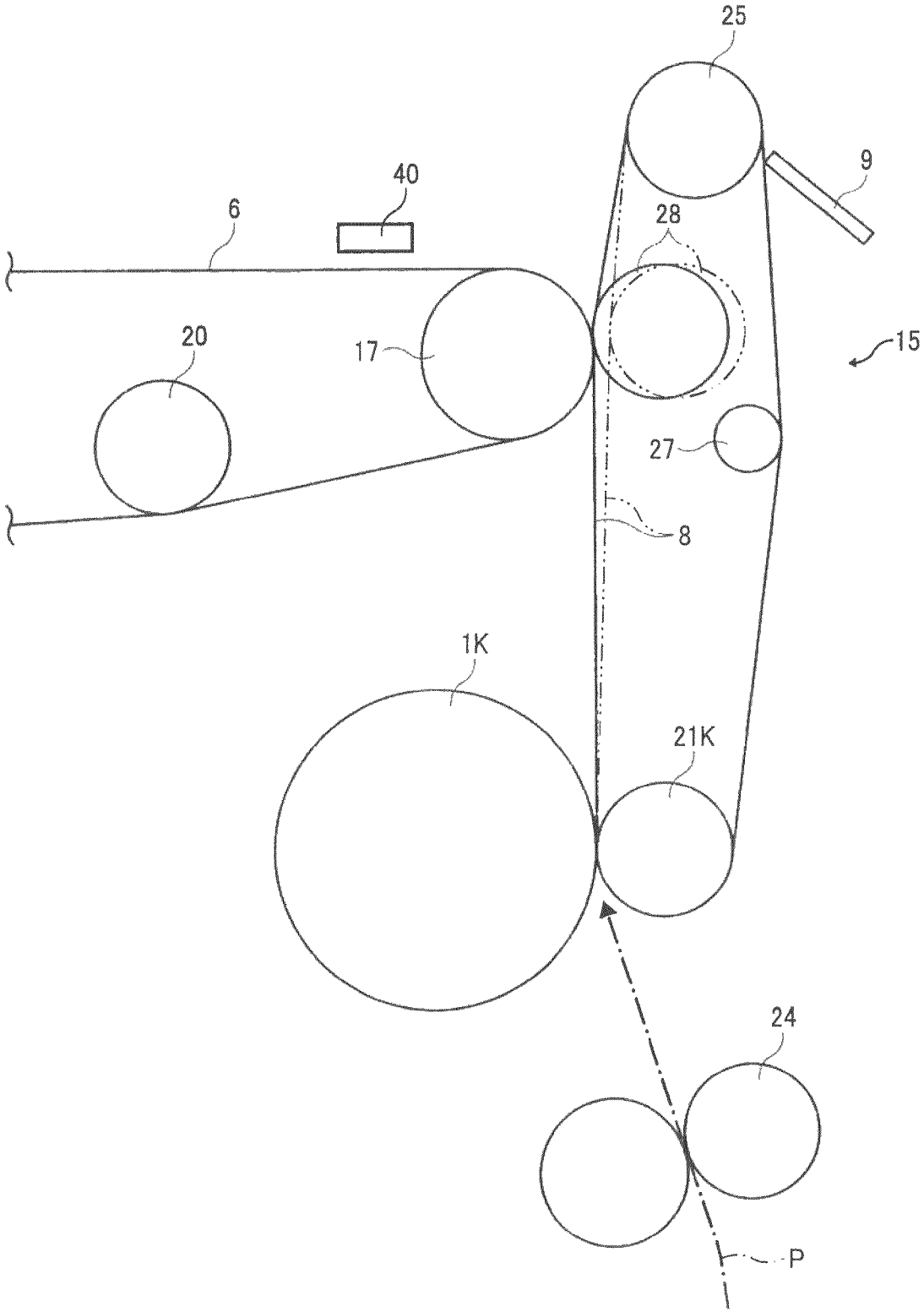
FIG. 2 is a schematic diagram of the configuration of a secondary transfer unit.

FIG. 2 is a schematic diagram of the configuration of the secondary transfer unit 15. As shown in FIG. 2, the secondary transfer unit 15 includes a transfer-sheet conveying belt 8, a driving roller 25 that supports the transfer-sheet conveying belt 8, a driven roller 21K that works as a transferring unit, a supporting roller 27, a secondary transfer roller 28 that works as a secondary transfer means, and a cleaning unit 9 that cleans the surface of the transfer-sheet conveying belt 8. The secondary transfer roller 28 is arranged opposed to the driving roller 17 and is movable close to and apart from the intermediate transfer belt 6 by operation of a secondary-transfer-unit moving mechanism (not shown).

Although, in the secondary transfer unit 15 according to the present embodiment, the secondary transfer roller 28 moves close to and apart from the intermediate transfer belt 6, the configuration is not limited thereto. It is possible to configure the entire transfer-sheet conveying belt 8 to swing about the driven roller 21K as the fulcrum.

A conventional technology is known that maintains the image carriers other than the black image carrier apart from the intermediate transfer belt during the monochrome-image forming operation. In this conventional technology, because only the intermediate transfer belt is driven, it is unnecessary to drive (idle) the image forming units other than black; however, because the intermediate transfer belt is displaced, the supporting force is subjected to change. As compared with the conventional technology, if the secondary transfer roller 28 or the entire transfer-sheet conveying belt 8 is configured displaceable, because the transfer-sheet conveying belt 8 having the circumferential length shorter than the circumferential length of the intermediate transfer belt 6 moves close to or apart from the intermediate transfer belt 6 with the intermediate transfer belt 6 being fixed (independent from the moving of the transfer-sheet conveying belt 8), the supporting force is not changed. Although it is possible to configure the intermediate transfer belt 6 having many alignment positions to move close to and apart from the transfer-sheet conveying belt 8, in such a case there is possibility that the accuracy in the positional alignment decreases with the elapse of time. As compared with the case, because the intermediate transfer belt 6 maintains in contact with photosensitive elements 1Y, 1C, and 1M in the present embodiment, it is possible to set the accuracy in the positional alignment of the rollers with the intermediate transfer belt 6 high, which improves a margin of belt skew. Moreover, the stable belt rotation improves a margin of the misalignment (color shift) in the full-color printing operation.

It is allowable to configure the driving roller 17 that supports the intermediate transfer belt 6 to displace using a unit (not shown) so that the intermediate transfer belt 6 moves close to and apart from the transfer-sheet conveying belt 8. In this case, because the orientation of the transfer sheet being conveyed along the conveying path does not change, the behavior of the transfer sheet moving from the transfer-sheet conveying belt 8 to the fixing device 10 cannot become unstable. This prevents a crease or a distorted image on the transfer sheet discharged from the fixing device 10. Moreover, it is allowable to configure both the secondary transfer roller 28 of the secondary transfer unit 15 and the driving roller 17 that supports the intermediate transfer belt 6 movable so that the intermediate transfer belt 6 and the transfer-sheet conveying belt 8 moves close to and apart from each other.

Referring back to FIG. 1, the image forming units 12Y, 12C, 12M, and 12K are formed as process cartridges detachable from the main body of the printer unit 300. Each image forming unit 12 (12Y, 12C, 12M, and 12K) includes a photosensitive element 1 (1Y, 1C, 1M, and 1K) that is an image carrier, a charging device 2 (2Y, 2C, 2M, and 2K), a developing device 3 (3Y, 3C, 3M, and 3K) that develops an electrostatic latent image to a toner image with toners, and a cleaning device 4 (4Y, 4C, 4M, and 4K). In the image forming units 12Y, 12C, 12M, and 12K, each of the photosensitive elements 1Y, 1C, 1M, and 1K is in contact with the lower-side extending surface of the intermediate transfer belt 6. Primary transfer rollers 21Y, 21C, and 21M that work as primary transfer means are arranged at positions inside of the intermediate transfer belt 6 opposed to the photosensitive elements 1Y, 1C, and 1M, respectively.

The printer unit 300 of the color digital MFP 100 includes an exposure device 5 that emits laser light from an LD (not shown) to the image forming units 12Y, 12C, 12M, and 12K.

Scanned data of an original obtained by the scanner unit 200, data received by FAX, or color image information received from a computer is resolved into yellow, cyan, magenta, and black; thus, data about color separation images is created. The data about color separation images is sent to the exposure device 5 of the image forming units 12Y, 12C, 12M, and 12K. The exposure device 5 emits the laser light to the photosensitive elements 1Y, 1C, 1M, and 1K in the image forming units 12Y, 12C, 12M, and 12K, thereby forming electrostatic latent images on the photosensitive elements 1Y, 1C, 1M, and 1K.

Although the cleaning devices 4Y, 4C, 4M, and 4K used in the present embodiment are blades, the present invention is not limited thereto. Some other cleaning devices, such as a fur brush roller and a magnetic brush cleaner, can be used. Although the exposure device 5 is a laser exposure device, some other exposure devices, such as an LED exposure device, can be used.

The printer unit 300 of the color digital MFP 100 includes pattern detecting sensors 40 on the left side, at the center, and on the right side of the intermediate transfer belt 6 with respect to the belt width direction. The pattern detecting sensors 40 detects a positional-alignment pattern set PT (see FIG. 6) to detect an amount of skew in the LD scanning (not shown).

If reflection-type optical sensors (specular-reflection sensors) are used as the pattern detecting sensors 40, the pattern detecting sensors 40 emit light to the intermediate transfer belt 6 and then detect the light reflected from the positional-alignment pattern set PT that is formed on the intermediate transfer belt 6 and the intermediate transfer belt 6, thereby obtaining information to measure an amount of the misalignment. In the positional alignment, it is possible to measure the skew from a reference color (any of Y, C, and M), the registration misalignment in the sub-scanning direction, the registration misalignment in the main-scanning direction, and the magnifying power in the main-scanning direction. The pattern detecting sensors 40 read edge parts of the positional-alignment pattern set PT.

Although the pattern detecting sensors 40 used in the present embodiment are specular-reflection sensors, the present invention is not limited thereto. Some other sensors, such as a diffused-light sensor unit that reads light diffused by the positional-alignment pattern set PT and the intermediate transfer belt 6, can be used.

Paper feed trays 22 and 23 are arranged in a lower part of the printer unit 300 of the color digital MFP 100. The size of sheets in the paper feed tray 22 is different from the size of sheets in the paper feed tray 23. After the transfer sheet P that is fed by a paper feed unit (not shown) from any of the paper feed trays 22 and 23, the transfer sheet P is conveyed by a conveyer unit (not shown) to a pair of registration rollers 24. The skew is corrected when the transfer sheet P is at the registration rollers 24. After that, the transfer sheet P is conveyed at specific timing by the registration rollers 24 to a transfer position between the photosensitive element 1K and the transfer-sheet conveying belt 8.

The printer unit 300 of the color digital MFP 100 includes toner tanks 32K, 32Y, 32C, and 32M. The toner tanks 32K, 32Y, 32C, and 32M are connected to the developing devices 3K, 3Y, 3C, and 3M via toner supply pipes 33K, 33Y, 33C, and 33M, respectively. Because the black image forming unit 12K is separated from the other image forming units 12Y, 12C, and 12M, toners on the photosensitive elements 1Y, 1C, and 1M cannot mix into the black image forming process. Therefore, toners collected from the photosensitive element 1K is conveyed to the black developing device 3K through a black-toner collecting path (not shown) for reuse. It is allowable to arrange a device in the middle of the black-toner collecting path to remove powders of paper or a device to switch to a disposal toner path.

Figure 3:
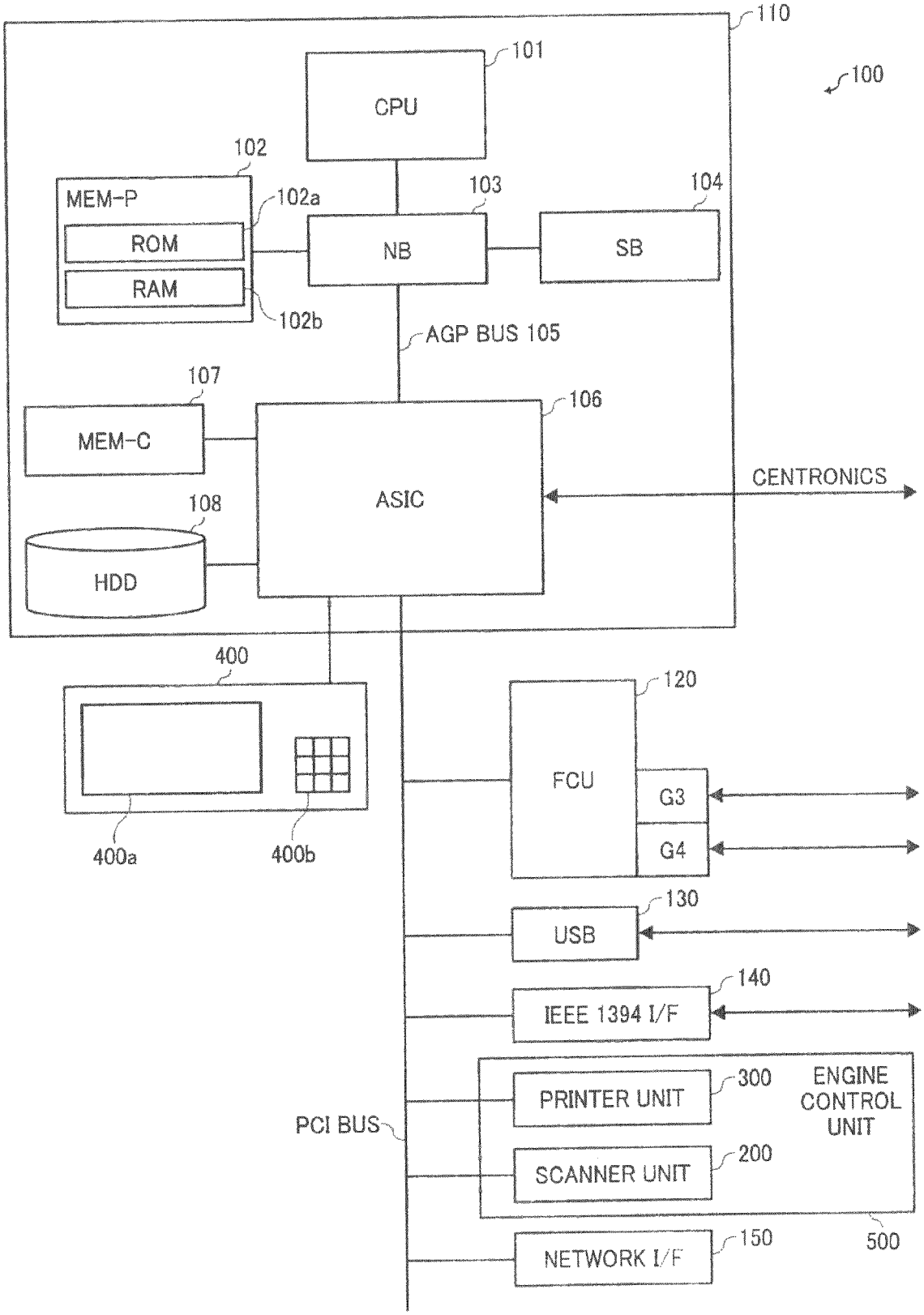
FIG. 3 is a block diagram of the hardware configuration of the color digital MFP.

The hardware configuration of the color digital MFP 100 is described below. FIG. 3 is a block diagram of the hardware configuration of the color digital MFP 100. As shown in FIG. 3, the color digital MFP 100 includes a controller 110, the printer unit 300, and the scanner unit 200 connected to each other via a peripheral component interconnect (PCI) bus. The controller 110 is a controller that controls the color digital MFP 100 and various inputs related to drawing and communication or inputs from the operation unit 400. An image processing unit that performs image processing, such as error diffusion and gamma conversion, is in the printer unit 300 or the scanner unit 200. The operation unit 400 includes an operation display unit 400*a* and a keyboard unit 400*b*. The operation display unit 400*a* displays information, such as original image information that is information about the original scanned by the scanner unit 200, on a liquid crystal display (LCD) and receives various inputs from the operator via a touch panel. The keyboard unit 400*b* receives various key inputs from the operator.

In the color digital MFP 100 according to the present embodiment, the document-box function, the copy function, the printer function, and the FAX function, are selectable by sequentially switching among these functions using the application switching key on the operation unit 400. When the document-box function is selected, the document-box mode is on; when the copy function is selected, the copy mode is on; when the printer function is selected, the printer mode is on; and the FAX function is selected, the FAX mode is on.

The controller 110 includes a central processing unit (CPU) 101 that is a main unit of the computer, a system memory (MEM-P) 102, a north bridge (NB) 103, a south bridge (SB) 104, an application specific integrated circuit (ASIC) 106, a local memory (MEM-C) 107 that is a storage unit, and a hard disk drive (HDD) 108 that is a storage unit. The NB 103 is connected to the ASIC 106 via an accelerated graphics port (AGP) bus 105. The MEM-P 102 includes a read only memory (ROM) 102*a* and a random access memory (RAM) 102*b*.

The CPU 101 controls the color digital MFP 100. The CPU 101 has a chip set that includes the NB 103, the MEM-P 102, and the SB 104. The CPU 101 is connected to some other devices via the chip set.

The NB 103 is a bridge that connects the CPU 101 to the MEM-P 102, the SB 104, and the AGP bus 105. The NB 103 includes a memory controller that controls read/write from/to the MEM-P 102; a PCI master; and an AGP target.

The MEM-P 102 is a system memory that is used as a memory that stores therein computer programs and data, a memory on which computer programs and data are loaded, a memory for painting in the printer mode, and the like. The MEM-P 102 includes the ROM 102*a* and the RAM 102*b*. The ROM 102*a* is a read only memory that stores therein computer programs and data that are used to control operations of the CPU 101. The RAM 102*b* is a writable and readable memory that is used as the memory on which computer programs and data are loaded and the memory for painting in the printer mode.

The SB 104 is a bridge that connects the NB 103 to PCI devices and peripheral devices. The SB 104 is connected to the NB 203 via a PCI bus. The PCI bus is connected to a network interface (I/F) 150, etc.

The ASIC 106 is an integrated circuit (IC) for image processing and has a hardware component for image processing.

The ASIC 106 works as a bridge that connects the AGP bus 105, the PCI bus, the HDD 108, and the MEM-C 107 to each other. The ASIC 106 includes a PCI target, an AGP master, an arbiter (ARB) that is the main unit of the ASIC 106, a memory controller that controls the MEM-C 107, a plurality of direct memory access controllers (DMACs) that perform rotation of image data or the like using a hardware logic, etc., and a PCI unit that perform data transfer via a PCI bus between the printer unit 300 and the scanner unit 200. The ASIC 106 is connected to a Fax control unit (FCU) 120, a universal serial bus (USB) 130, an IEEE 1394 (the Institute of Electrical and Electronics Engineers 1394) I/F 140 via a PCI bus.

The MEM-C 107 is a local memory that is used as a copy image buffer and a code buffer. The HDD 108 is a storage that stores therein image data, computer programs that are used to control operations of the CPU 101, font data, and forms.

The AGP bus 105 is a bus interface for a graphics accelerator card that is proposed to increase a graphics processing speed. With a direct access to the MEM-P 102 at a high throughput, the AGP bus 105 increases the speed of the graphics accelerator card.

The computer program that is executed by the color digital MFP 100 according to the present embodiment is stored in a ROM or the like. The computer program that is executed by the color digital MFP 100 according to the present embodiment can be stored, in a form of a file that is installable and executable on a computer, in a recording medium readable by the computer, such as a compact disk-read only memory (CD-ROM), a flexible disk (FD), a compact disk-recordable (CD-R), and a digital versatile disk (DVD).

On the other hand, the computer program that is executed by the color digital MFP 100 according to the present embodiment can be stored in another computer connected to the computer via a network such as the Internet, and downloaded to the computer via the network. The computer program that is executed by the color digital MFP 100 according to the present embodiment can be delivered or distributed via a network such as the Internet.

Figure 4:
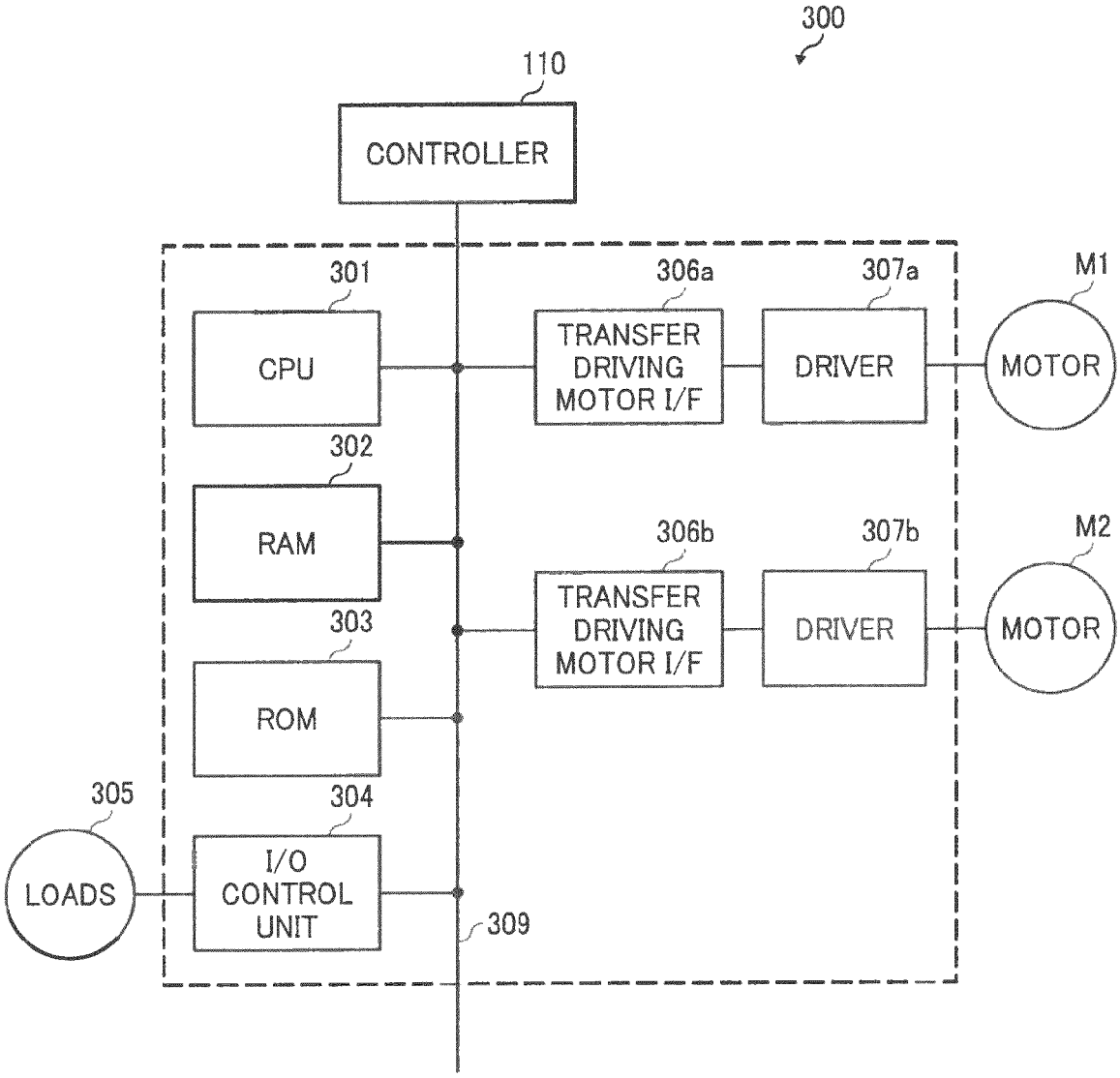
FIG. 4 is a block diagram of the hardware configuration of a printer unit.

FIG. 4 is a block diagram of the hardware configuration of the printer unit 300. As shown in FIG. 4, the control system of the printer unit 300 includes a CPU 301, a RAM 302, a ROM 303, an I/O control unit 304, a transfer driving motor I/F 306*a*, a driver 307*a*, a transfer driving motor I/F 306*b*, and a driver 307*b*.

The CPU 301 controls the printer unit 300, for example, controls receiving of image data from the controller 110 and sending/receiving of control commands.

The RAM 302 that is used for a work, the ROM 303 that stores therein computer programs, and the I/O control unit 304 are connected to each other via a bus 309. According to instructions received from the CPU 301, the I/O control unit 304 performs various operations of drive motors, clutches, solenoids, sensors, etc., that drive loads 305. The loads 305 include, for example, a data read/write mechanism and the secondary-transfer-unit moving mechanism.

The transfer driving motor I/F 306*a* outputs, according to a driving instruction received from the CPU 301, an instruction signal to the driver 307*a* to set a frequency of a driving pulse signal. A transfer driving motor M1 rotates according to the frequency. By this rotation, the driving roller 17 shown in FIG. 2 rotates. The transfer driving motor I/F 306*b* outputs, according to a driving instruction received from the CPU 301, an instruction signal to the driver 307*b* to set a frequency of a driving pulse signal. A transfer driving motor M2 rotates according to the frequency. By this rotation, the driving roller 25 shown in FIG. 2 rotates.

The RAM 302 is used as a work area to execute a computer program stored in the ROM 303. Because the RAM 302 is a volatile memory, parameters that are used for next belt driving, such as an amplitude and a phase value, are stored in a nonvolatile memory, such as an electrically erasable programmable read only memory (EEPROM) (not shown). When the power is on or a transfer driving motor M1 starts rotating, data about a belt cycle is loaded on the RAM 302 using a sine function or an approximate expression.

The computer program executed by the printer unit 300 according to the present embodiment is, for example, made up of modules that implement a print control unit 51, a positional-alignment control unit 52, an indirect-transfer control unit 53, a direct-transfer control unit 54, a secondary-transfer control unit 55, etc. (see FIG. 5). These units will be described in detail later. When the CPU 301 reads the computer program from the above-described ROM 303 and executes the computer program, the above modules are loaded and created on a main memory thereby implementing the print control unit 51, the positional-alignment control unit 52, the indirect-transfer control unit 53, the direct-transfer control unit 54, the secondary-transfer control unit 55, etc.

Figure 5:
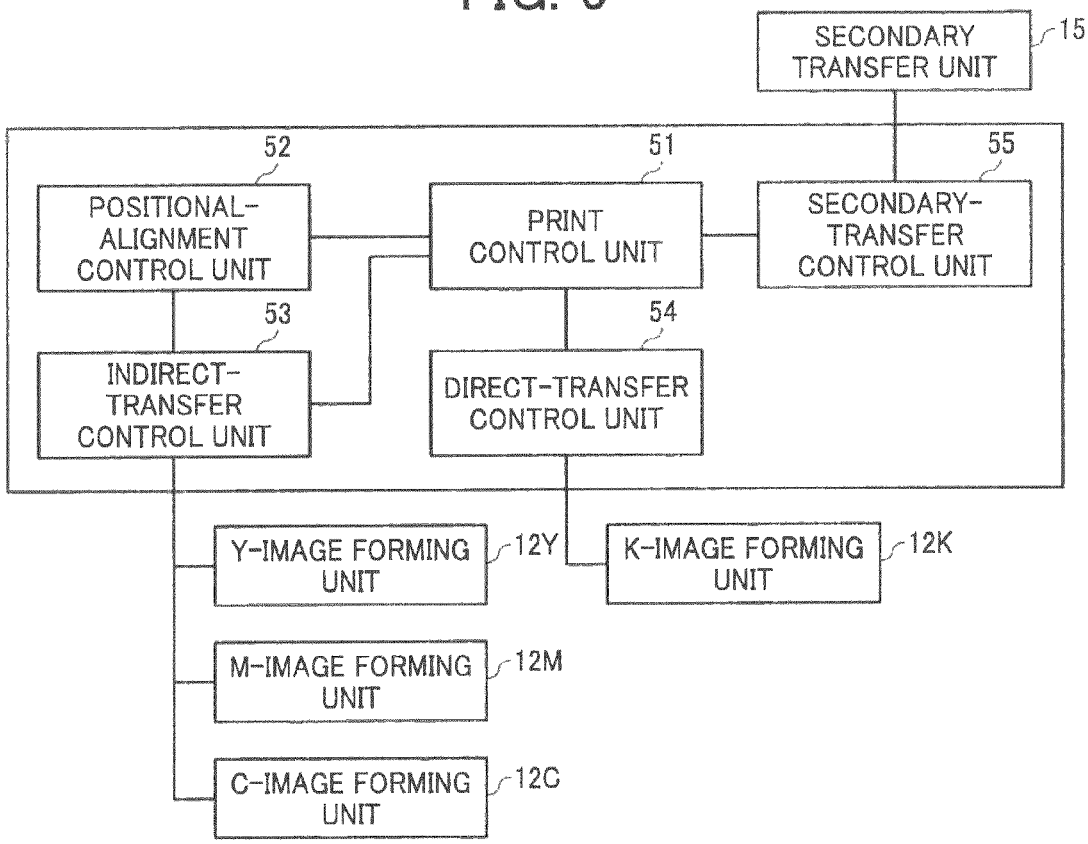
FIG. 5 is a block diagram of the functional configuration of the printer unit.

FIG. 5 is a block diagram of the functional configuration of the printer unit 300. The functional block diagram in FIG. 5 illustrates functions or units that are implemented by executing the computer program according to the present embodiment. When the CPU 301 operates according to the computer program, the print control unit 51, the positional-alignment control unit 52, the indirect-transfer control unit 53, the direct-transfer control unit 54, and the secondary-transfer control unit 55 are implemented as units of the printer unit 300.

The print control unit 51 controls the units of the printer unit 300 (the positional-alignment control unit 52, the indirect-transfer control unit 53, the direct-transfer control unit 54, the secondary-transfer control unit 55, etc.) to perform full-color printing and monochrome printing.

In the full-color printing, the indirect-transfer control unit 53 causes the image forming units 12Y, 12C, and 12M and the intermediate transfer belt 6 to form an image to be transferred onto the transfer sheet P (hereinafter, "YCM toner image"). More particularly, under the control of the indirect-transfer control unit 53, the Y, C, and M toner images formed on the photosensitive elements 1Y, 1C, and 1M of the image forming units 12Y, 12C, and 12M are transferred onto the intermediate transfer belt 6 in the superimposed manner using the indirect transfer method. In the full-color printing, the secondary-transfer control unit 55 moves the secondary transfer roller 28 of the secondary transfer unit 15 close to the intermediate transfer belt 6 so that the transfer sheet P can receive the YCM toner image. In this manner, the YCM toner image, which is formed on the intermediate transfer belt 6 in the superimposed manner using the indirect transfer method, is transferred onto the transfer sheet P by the secondary transfer roller 28 of the secondary transfer unit 15.

The indirect-transfer control unit 53 causes the image forming units 12Y, 12C, and 12M and the intermediate transfer belt 6 to form an image of the positional-alignment pattern set PT (see FIG. 6), which is used to perform positional alignment with the positional-alignment control unit 52, on the intermediate transfer belt 6. In the process of forming the image of the positional-alignment pattern set, the secondary-transfer control unit 55 moves the secondary transfer roller 28 of the secondary transfer unit 15 apart from the intermediate transfer belt 6 because it is unnecessary to transfer the Y, C, and M toner images to the transfer sheet P.

In both the full-color printing and the monochrome printing, the direct-transfer control unit 54 causes the image forming unit 12K to form an image to be transferred onto the transfer sheet P. More particularly, under the control of the direct-transfer control unit 54, the K toner image is formed on the photosensitive element 1K of the image forming unit 12K. In the monochrome printing, the secondary-transfer control unit 55 moves the secondary transfer roller 28 apart from the intermediate transfer belt 6 because it is unnecessary to transfer the Y, C, and M toner images. In this manner, the formed K toner image is transferred onto the transfer sheet P by the secondary transfer roller 28 of the secondary transfer unit 15 using the direct transfer method. As described above, in the full-color printing, the secondary-transfer control unit 55 moves the secondary transfer roller 28 of the secondary transfer unit 15 close to the intermediate transfer belt 6 so that the transfer sheet P can receive the YCM toner image.

Figure 6:
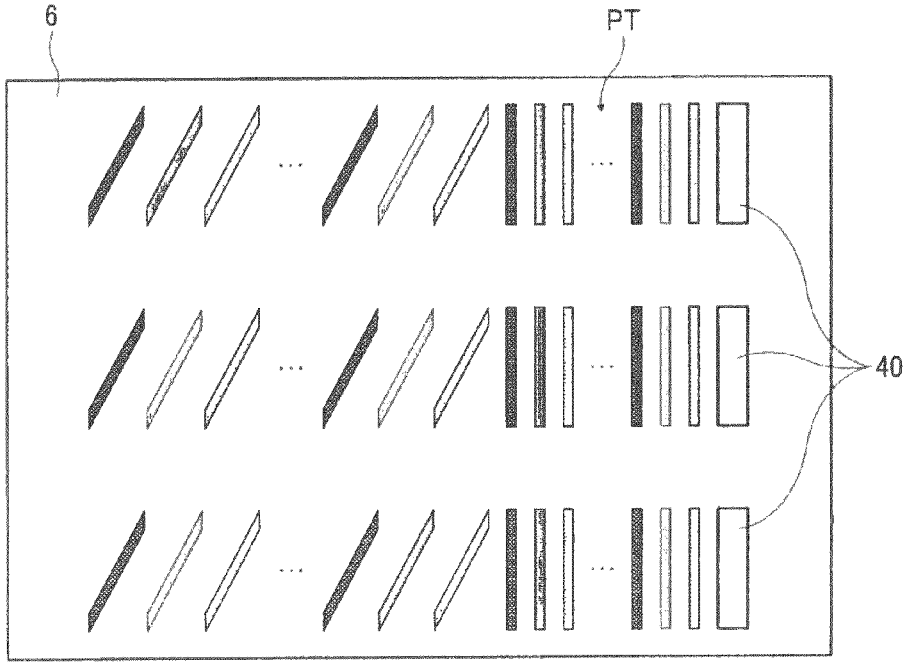
FIG. 6 is a plane view of an example of a positional-alignment pattern set.

The positional-alignment control unit 52 detects misalignment (color shift) of the color images, which are formed on the image forming units 12Y, 12C, and 12M by the indirect-transfer control unit 53 and then transferred on the intermediate transfer belt 6 in the superimposed manner, and calculates a correction amount. For the positional alignment, to detect an amount of the misalignment, the positional-alignment pattern set PT shown in FIG. 6 is formed on the intermediate transfer belt 6. FIG. 6 is a plane view of an example of the positional-alignment pattern set PT. As shown in FIG. 6, the positional-alignment pattern set PT includes three parallel straight patterns and three slant patterns aligned at equal intervals in the sub-scanning direction. Several positional-alignment pattern sets PT are formed along the moving direction of the intermediate transfer belt 6. The three pairs of the patterns that constitute the positional-alignment pattern set PT are formed with yellow (Y), cyan (C), and magenta (M) toners. Because as the number of samples increases, a degree of affect caused by the error reduces, several positional-alignment pattern sets PT are output at positions corresponding to the pattern detecting sensors 40 as shown in FIG. 6.

Figure 7A:
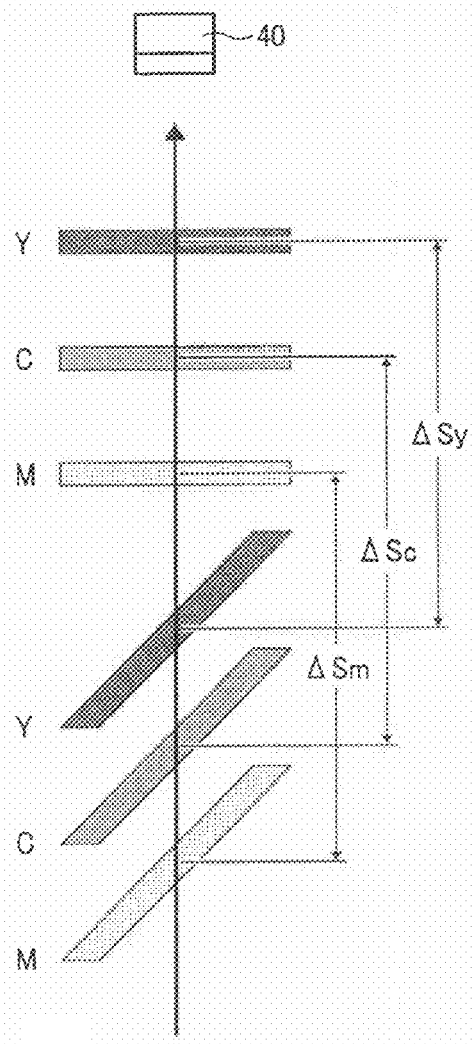
FIG. 7A is a schematic diagram that explains a manner of calculating misalignment in the main-scanning direction.
Figure 7B:
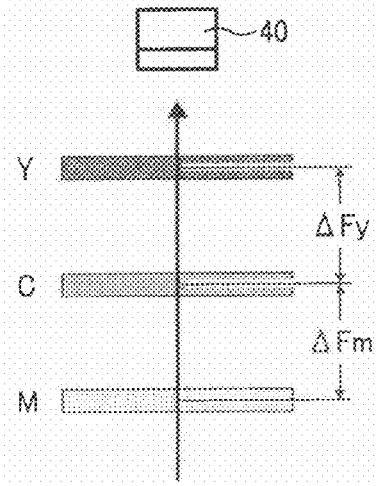
FIG. 7B is a schematic diagram that explains a manner of calculating misalignment in the sub-scanning direction.

Various manners of calculating the correction amount for positional alignment performed by the positional-alignment control unit 52 are known. A manner of calculating an amount of the misalignment is described below with reference to FIGS. 7A and 7B. FIG. 7A is a schematic diagram that explains a manner of calculating misalignment in the main-scanning direction. FIG. 7B is a schematic diagram that explains a manner of calculating misalignment in the sub-scanning direction. As shown in FIG. 7A, an amount of the misalignment in the main-scanning direction is calculated by measuring distances between the straight patterns and the respective slant patterns ($\Delta Sc$, $\Delta Sy$, and $\Delta Sm$) using the timer of the CPU 101, converting time into length, and comparing the lengths with each other. On the other hand, as shown in FIG. 7B, an amount of the misalignment in the sub-scanning direction is calculated by measuring distances from the reference color (C in this example) ($\Delta Fy$ and $\Delta Fm$) using the timer of the CPU 101, converting time into length, and comparing the lengths with the ideal length. In this manner, an amount of the misalignment from the ideal distance is calculated on the color basis and the calculated amount is sent to each of the image forming units 12Y, 12C, and 12M as feedback. The misalignment (color shift) is corrected using the calculated amount of the misalignment.

How the print control unit 51 controls the system (the positional-alignment control unit 52, the indirect-transfer control unit 53, the direct-transfer control unit 54, and the secondary-transfer control unit 55) is described below with examples.

How the print control unit 51 controls the system during the full-color image forming process is described below. During the full-color image forming process, the print control unit 51 drives the indirect-transfer control unit 53, the direct-transfer control unit 54, the secondary-transfer control unit 55, etc. FIG. 8 is a schematic diagram that explains the operations of the photosensitive elements 1Y, 1C, 1M, and 1K and the secondary transfer roller 28 during the full-color printing. As shown in FIG. 8, during the full-color image forming process, in order to transfer all the Y, C, M, and K images onto the transfer sheet P, the print control unit 51 causes the photosensitive elements 1Y, 1C, and 1M of the image forming units 12Y, 12C, and 12M to perform the printing operation and moves the secondary transfer roller 28 of the secondary transfer unit 15 close to the intermediate transfer belt 6. The status of the secondary transfer roller 28 "in contact" shown in FIG. 8 means that the secondary transfer roller 28 is close to the secondary transfer roller 28.

Under the control of the print control unit 51, the photosensitive elements 1Y, 1C, 1M, and 1K with the surfaces charged evenly by the charging devices 2Y, 2C, 2M, and 2K are exposed to the color-based exposure light coming from the exposure device 5, and the developing devices 3Y, 3C, 3M, and 3K develops the electrostatic latent images into toner images. After that, under the control of the print control unit 51, the color toner images formed on the photosensitive elements 1Y, 1C, and 1M are transferred onto the intermediate transfer belt 6 at the appropriate timing and therefore the superimposed toner image is formed. The black toner image formed on the photosensitive element 1K is, under the control of the print control unit 51, transferred directly onto the transfer sheet P being conveyed by the transfer-sheet conveying belt 8. After that, the YCM toner image, which is formed on the intermediate transfer belt 6 in the superimposed manner, is transferred onto the transfer sheet P. The transfer-sheet conveying belt 8 works as a direct transfer belt in the transferring unit of the black toner image, while working as a secondary transfer belt in the transferring unit of the YCM toner image formed on the intermediate transfer belt 6.

After that, under the control of the print control unit 51, the fixing device 10 fixes the toner image that is formed by superimposing the black toner image with the YCM toner image onto the transfer sheet P, thereby forming a color image. After the color image is fixed, under the control of the print control unit 51, the transfer sheet P is conveyed through a conveying path R1 (see FIG. 1) and then discharged by a pair of discharge rollers 30 to a discharge tray 31 so that the transfer sheet P is stacked facedown. If the duplex-printing mode is selected, under the control of the print control unit 51, the transfer sheet P is conveyed through a conveying path R2 by operation of a switching claw (not shown) and a duplex-printing unit 33 turns the backside of the transfer sheet P up. The backside-up transfer sheet P is conveyed to the registration rollers 24 and then conveyed along the discharging path in the same manner as in the single-side printing.

How the print control unit 51 controls the system during the monochrome image forming process is described below. During the monochrome image forming process, the print control unit 51 drives the direct-transfer control unit 54, the secondary-transfer control unit 55, etc. FIG. 9 is a schematic diagram that explains the operations of the photosensitive elements 1Y, 1C, 1M, and 1K and the secondary transfer roller 28 during the monochrome printing. As shown in FIG. 9, during the monochrome image forming process, the print control unit 51 causes only the photosensitive element 1K of the image forming unit 12K to perform the printing operation so that only the K image is transferred onto the transfer sheet P.

The print control unit 51 moves the secondary transfer roller 28 of the secondary transfer unit 15 apart from the intermediate transfer belt during the monochrome image forming process. The status of the secondary transfer roller 28 "not in contact" shown in FIG. 9 means that the secondary transfer roller 28 is not in contact with the intermediate transfer belt 6.

Under the control of the print control unit 51, the exposure device 5 exposes an imaging area of the photosensitive element 1K to the exposure light according to data about the black image, and the developing device 3K forms a black toner image. Under the control of the print control unit 51, the formed black toner image is directly transferred onto the transfer sheet P being conveyed by the transfer-sheet conveying belt 8 and fixed to the transfer sheet P by the fixing device 10. As a result, the monochrome image is formed. During the monochrome image forming process, as shown in FIG. 2, the print control unit 51 causes the secondary-transfer-unit moving mechanism to set the intermediate transfer belt 6 and the transfer-sheet conveying belt 8 apart from each other as indicated by the dash-dotted line and maintains the image forming units 12Y, 12C, and 12M and the intermediate transfer belt 6 in the unoperated state. This increases the operating life of the image forming units 12Y, 12C, and 12M and the intermediate transfer belt 6 as a secondary effect.

How the print control unit 51 controls the system during the positional alignment is described below. During the positional alignment, the print control unit 51 drives the positional-alignment control unit 52, the indirect-transfer control unit 53, the direct-transfer control unit 54, the secondary-transfer control unit 55, etc. FIG. 10 is a schematic diagram that explains the operations of the photosensitive elements and the secondary transfer roller during the positional alignment. As shown in FIG. 10, during the positional alignment, in order to transfer only the K image onto the transfer sheet P, the print control unit 51 causes only the photosensitive element 1K of the image forming unit 12K to perform the printing operation and moves the secondary transfer roller 28 of the secondary transfer unit 15 apart from the intermediate transfer belt. Moreover, during the positional alignment, in order to form the image of the Y, C, and M colored positional-alignment pattern set PT (see FIG. 6) on the intermediate transfer belt 6, the print control unit 51 causes the photosensitive elements 1Y, 1C, and 1M of the image forming units 12Y, 12C, and 12M to perform the printing operation.

In other words, under the control of the print control unit 51, both the monochrome printing operation using the image forming unit 12K and the positional alignment for the image forming units 12Y, 12C, and 12M are performed in parallel.

Under the control of the print control unit 51, the exposure device 5 exposes an imaging area of the photosensitive element 1K to the exposure light according to data about the black image and the developing device 3K develops the electrostatic latent image into a toner image. Under the control of the print control unit 51, the formed black toner image is directly transferred onto the transfer sheet P being conveyed by the transfer-sheet conveying belt 8 and fixed to the transfer sheet P by the fixing device 10. As a result, the monochrome image is formed. During the monochrome image forming process, as shown in FIG. 2, the print control unit 51 causes the secondary-transfer-unit moving mechanism to set the intermediate transfer belt 6 and the transfer-sheet conveying belt 8 apart from each other as indicated by the dash-dotted line. Moreover, in order to form the Y, C, and M positional-alignment pattern set PT on the intermediate transfer belt 6 and scan the position of the positional-alignment pattern set PT, the print control unit 51 causes the photosensitive elements 1Y, 1C, and 1M to perform the process of forming the image of the positional-alignment pattern set PT. Because the intermediate transfer belt 6 and the transfer-sheet conveying belt 8 are apart from each other, toners that are used in the process of forming the image of the positional-alignment pattern set PT are not attached to the transfer-sheet conveying belt 8; therefore, when the printing operation is performed, the undesired toners, i.e., the toners of the positional-alignment pattern set PT cannot be transferred to the backside of the transfer sheet P. Moreover, a damaged image may be formed on the intermediate transfer belt 6 depending on the positions of the pattern detecting sensors 40 and may adversely affects scanning result. This configuration prevents such a problem.

The print control unit 51 does not have to perform the color alignment during the black-image printing. If no monochrome printing data is present, the print control unit 51 can perform only the positional alignment without performing the black-image printing.

The transition in the status of the print control unit 51 is described below with examples.

FIG. 11 is a schematic diagram that explains a first example of the system control in which the status transits from the full-color printing to the monochrome printing and then stops. As shown in FIG. 11, if the status transits from the full-color printing to the monochrome printing, the print control unit 51 instructs the indirect-transfer control unit 53 to stop the indirect transfer while instructing the positional-alignment control unit 52 and the secondary-transfer control unit 55 to perform the positional alignment. The secondary-transfer control unit 55 moves the secondary transfer roller 28 apart from the intermediate transfer belt 6. The positional-alignment control unit 52 instructs, via the indirect-transfer control unit 53, the photosensitive elements 1Y, 1C, and 1M of the image forming units 12Y, 12C, and 12M to output the positional-alignment pattern set PT, scans using the pattern detecting sensors 40 the positional-alignment pattern set PT formed on the intermediate transfer belt 6, detects an amount of the misalignment (color shift) of the Y, C, and M patterns, and calculates a correction amount for the positional alignment. After that, the image forming units 12Y, 12C, and 12M perform the image outputting according to the calculated correction amount. The print control unit 51 instructs the direct-transfer control unit 54 to output a monochrome image, thereby starting the monochrome printing in parallel with the positional alignment. When the monochrome printing is finished, the print control unit 51 instructs the direct-transfer control unit 54 to stop operation. When the positional alignment is finished, the positional-alignment control unit 52 instructs the indirect-transfer control unit 53 to stop operation.

FIG. 12 is a schematic diagram that explains that explains a second example of the system control in which the status transits from the full-color printing to the monochrome printing, then stops, and then back to the monochrome printing. The second example shown in FIG. 12 illustrates the case where, when the print control unit 51 instructs the direct-transfer control unit 54 to stop operation after the completion of the monochrome printing in the same manner as in the first example shown in FIG. 11, the monochrome printing is performed during the positional-alignment control unit 52 being in the positional alignment. In this case, the print control unit 51 causes the positional-alignment control unit 52 to continue the positional alignment. Moreover, in this case, the print control unit 51 instructs the direct-transfer control unit 54 to start the printing operation without waiting for the completion of the positional alignment performed by the positional-alignment control unit 52. The direct-transfer control unit 54 instructs the image forming unit 12K to perform the image formation and thus the monochrome printing starts.

A third example of the system control shown in FIG. 13 illustrates the case where, when the print control unit 51 instructs the direct-transfer control unit 54 to stop operation after the completion of the monochrome printing in the same manner as in the first example shown in FIG. 11, the full-color printing is performed during the positional-alignment control unit 52 being in the positional alignment. In this case, because the full-color printing, which is implemented by operations of the indirect-transfer control unit 53 and the direct-transfer control unit 54 under the control of the print control unit 51, needs the image formation using the indirect transfer method, the full-color printing cannot be performed during a period when the positional-alignment control unit 52 causes the indirect-transfer control unit 53 to perform the positional alignment. Therefore, the print control unit 51 causes the direct-transfer control unit 54 to maintain the image forming unit 12K in the standby state until the positional alignment of the other photosensitive elements 1Y, 1C, and 1M is completed. The standby state means that the image forming unit 12K is ready to start the printing operation as soon as the photosensitive elements 1Y, 1C, and 1M are ready. The standby state can be equivalent to "stop state" on the hardware.

FIG. 14 is a schematic diagram that explains a fourth example of the system control in which the positional alignment is performed during the full-color printing. In the fourth example shown in FIG. 14, because the full-color printing cannot be performed during the positional alignment as described above, when the positional alignment is performed during the full-color printing, the print control unit 51 causes the indirect-transfer control unit 53 and the direct-transfer control unit 54 to suspend the full-color printing operation and causes the secondary-transfer control unit 55 to move the secondary transfer roller 28 apart from the intermediate transfer belt 6. After that, the print control unit 51 causes the positional-alignment control unit 52 to cause the indirect-transfer control unit 53 to perform the positional alignment. After the completion of the positional alignment, the print control unit 51 causes the secondary-transfer control unit 55 to move the secondary transfer roller 28 close to the intermediate transfer belt 6 and causes the indirect-transfer control unit 53 and the direct-transfer control unit 54 to resume the full-color printing.

As described above, according to the present embodiment, the print control unit 51 moves the secondary transfer unit 15 apart from the intermediate transfer belt 6, in which the secondary transfer unit 15 is located at a position along the conveying path at which both the multi-color image, which is formed under the control of the indirect-transfer control unit 53 on the intermediate transfer belt 6 in the superimposed manner, and the black image, which is formed and transferred onto the transfer sheet P under the control of the direct-transfer control unit 54, join together in the superimposed manner. The print control unit 51 causes the direct-transfer control unit 54 to cause the image forming unit 12K to form the black image and transfer the black image onto the transfer sheet P being conveyed along the conveying path and causes the positional-alignment control unit 52 to perform the positional alignment. With this configuration, both the monochrome printing operation performed by the black image forming unit 12K under the control of the direct-transfer control unit 54 and the positional alignment of the image forming units other than black, i.e., the image forming units 12Y, 12C, and 12M are performed in parallel; therefore, the misalignment (color shift) of the image forming units 12Y, 12C, and 12M is corrected while maintaining the performance of the monochrome printing performed by the black image forming unit 12K under the control of the direct-transfer control unit 54.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A color-image forming apparatus comprising:

a direct-transfer control unit that causes a black image forming unit to form a black image to be transferred onto a transfer sheet being conveyed along a conveying path;

an indirect-transfer control unit that causes a plurality of color image forming units other than the black image forming unit and an intermediate transfer member to form, on the intermediate transfer member, a multi-color image in a superimposed manner to be transferred onto the transfer sheet being conveyed along the conveying path;

a positional-alignment control unit that performs positional alignment by detecting amounts of main-scanning and sub-scanning directional misalignment of color images that are formed by the color image forming units other than the black image forming unit and then transferred onto the intermediate transfer member in the superimposed manner and correcting the misalignment;

a secondary transfer unit that is located at a position on the conveying path of the transfer sheet at which both the multi-color image, which is formed on the intermediate transfer member in the superimposed manner under control of the indirect-transfer control unit, and the black image, which is formed and transferred onto the transfer sheet under control of the direct-transfer control unit, join together in a superimposed manner, and that is provided movable close to and apart from the intermediate transfer member;

a secondary-transfer control unit that moves the secondary transfer unit close to and apart from the intermediate transfer member; and a print control unit that causes the secondary-transfer control unit to move the secondary transfer unit apart from the intermediate transfer member, causes the direct-transfer control unit to cause the black image forming unit to form the black image and transfer the black image onto the transfer sheet being conveyed along the conveying path, and causes the positional-alignment control unit to perform the positional alignment.

2. The color-image forming apparatus according to claim 1, wherein the print control unit causes the secondary-transfer control unit to move the secondary transfer unit apart from the intermediate transfer member and causes, during monochrome-printing operation in which the direct-transfer control unit causes the black image forming unit to form the black image and transfer the black image onto the transfer sheet being conveyed along the conveying path, the positional-alignment control unit to perform the positional alignment.

3. The color-image forming apparatus according to claim 1, wherein the print control unit causes the secondary-transfer control unit to move the secondary transfer unit apart from the intermediate transfer member and causes, during the positional alignment performed by the positional-alignment control unit, the direct-transfer control unit to start monochrome-printing operation in which the black image forming unit forms the black image and transfers the black image onto the transfer sheet being conveyed along the conveying path.

4. The color-image forming apparatus according to claim 1, wherein, if monochrome-printing operation performed by the direct-transfer control unit is completed during the positional alignment performed by the positional-alignment control unit, the print control unit causes the positional-alignment control unit to continue the positional alignment.

5. The color-image forming apparatus according to claim 4, wherein, if the monochrome-printing operation performed by the direct-transfer control unit is to be resumed, the print control unit instructs the direct-transfer control unit to start the monochrome-printing operation without waiting for the completion of the positional alignment performed by the positional-alignment control unit.

6. The color-image forming apparatus according to claim 4, wherein, if full-color printing operation performed by the indirect-transfer control unit and the direct-transfer control unit is to be started, the print control unit maintains the direct-transfer control unit in a standby state until the end of the positional alignment performed by the positional-alignment control unit.

7. The color-image forming apparatus according to claim 1, wherein, if the positional alignment performed by the positional-alignment control unit is to be performed during full-color printing operation performed by the indirect-transfer control unit and the direct-transfer control unit, the print control unit causes the indirect-transfer control unit and the direct-transfer control unit to suspend the full-color printing operation.

8. A color-image forming method that is performed by a color-image forming apparatus that includes a direct-transfer control unit that causes a black image forming unit to form a black image to be transferred onto a transfer sheet being conveyed along a conveying path;

an indirect-transfer control unit that causes a plurality of color image forming units other than the black image forming unit and an intermediate transfer member to form, on the intermediate transfer member, a multi-color image in a superimposed manner to be transferred onto the transfer sheet being conveyed along the conveying path;

a positional-alignment control unit that performs positional alignment by detecting amounts of main-scanning and sub-scanning directional misalignment of color images that are formed by the color image forming units other than the black image forming unit and then transferred onto the intermediate transfer member in the superimposed manner and correcting the misalignment;

a secondary-transfer control unit that moves a secondary transfer unit close to and apart from the intermediate transfer member, wherein the secondary transfer unit is located at a position along the conveying path of the transfer sheet at which both the multi-color image, which is formed on the intermediate transfer member in the superimposed manner under control of the indirect-transfer control unit, and the black image, which is formed and transferred onto the transfer sheet under control of the direct-transfer control unit, join together in a superimposed manner, and the secondary transfer unit is provided movable close to and apart from the intermediate transfer member;

a controller that includes a print control unit; and a storage unit, the color-image forming method comprising:

under control of the print control in the controller, causing the secondary-transfer control unit to move the secondary transfer unit apart from the intermediate transfer member; causing the direct-transfer control unit to cause the black image forming unit to form the black image and transfer the black image onto the transfer sheet being conveyed along the conveying path; and causing the positional-alignment control unit to perform the positional alignment.

9. A computer program product comprising a non-transitory computer-usable medium having computer-readable program codes embodied in the medium for forming a color image in a color-image forming apparatus that includes:

a direct-transfer control unit that causes a black image forming unit to form a black image to be transferred onto a transfer sheet being conveyed along a conveying path;

an indirect-transfer control unit that causes a plurality of color image forming units other than the black image forming unit and an intermediate transfer member to form, on the intermediate transfer member, a multi-color image in a superimposed manner to be transferred onto the transfer sheet being conveyed along the conveying path;

a positional-alignment control unit that performs positional alignment by detecting amounts of main-scanning and sub-scanning directional misalignment of color images that, are formed by the color image forming units other than the black image forming unit and then transferred onto the intermediate transfer member in the superimposed manner and correcting the misalignment; and a secondary-transfer control unit that moves a secondary transfer unit close to and apart from the intermediate transfer member, wherein the secondary transfer unit is located at a position along the conveying path of the transfer sheet at which both the multi-color image, which is formed on the intermediate transfer member in the superimposed manner under control of the indirect-transfer control unit, and the black image, which is formed and transferred onto the transfer sheet under control of the direct-transfer control unit, join together in a superimposed manner, and the secondary transfer unit is provided movable close to and apart from the intermediate transfer member, the program codes when executed causing a computer to execute:

causing the secondary-transfer control unit to move the secondary transfer unit apart from the intermediate transfer member;

causing the direct-transfer control unit to cause the black image forming unit to form the black image and transfer the black image onto the transfer sheet being conveyed along the conveying path; and causing the positional-alignment control unit to perform the positional alignment.

* * * * *